United States Patent [19]

Cooke et al.

[11] 4,097,342

[45] Jun. 27, 1978

[54] ELECTROPLATING ALUMINUM STOCK

[75] Inventors: William Ernest Cooke; John Hodgson, both of Kingston, Canada; Mitsuo Sasaki, Tondabayshi, Japan

[73] Assignee: Alcan Research and Development Limited, Montreal, Canada

[21] Appl. No.: 750,352

[22] Filed: Dec. 14, 1976

Related U.S. Application Data

[63] Continuation of Ser. No. 578,324, May 16, 1975, abandoned.

[51] Int. Cl.[2] ..... C25D 5/44; C25D 7/06; C25D 17/00

[52] U.S. Cl. ..... 204/28; 204/33; 204/206; 204/207

[58] Field of Search ..... 204/28, 33, 206, 207, 204/208, 209, 210

[56] References Cited

U.S. PATENT DOCUMENTS

| | | | |
|---|---|---|---|
| 1,517,910 | 12/1924 | Kirschner | 204/209 X |
| 2,708,655 | 5/1955 | Turner | 204/140.5 |
| 3,074,857 | 1/1963 | Altenpohl | 204/28 |
| 3,075,894 | 1/1963 | Ricks | 204/33 |
| 3,644,189 | 2/1972 | Moyer | 204/209 |
| 3,718,547 | 2/1973 | Cooke et al. | 204/28 |

FOREIGN PATENT DOCUMENTS

| | | | |
|---|---|---|---|
| 290,903 | 5/1928 | United Kingdom | 204/33 |

*Primary Examiner*—G. L. Kaplan
*Attorney, Agent, or Firm*—Cooper, Dunham, Clark, Griffin & Moran

[57] ABSTRACT

A process for the production of electroplated aluminium stock, such as strip or wire, comprises passing the stock continuously through a bath having a high dissolving power for aluminium oxide, such as strong aqueous sulphuric acid and phosphoric acid and subsequently through an electroplating bath, the first bath having a cathode electrode and the electroplating bath having an anode electrode so that the stock is anodic in the first bath. The stock may pass through one or more intermediate non-electrolytic treatment stages, such as immersion tinning or zincating. It may also pass through one or more electrolytic pretreatment stages during its passage between the first bath and the electroplating bath. In such pretreatment stages, such as the application of a bronze strike, there may be an anode electrode at the same potential as the anode in the electroplating bath.

5 Claims, 3 Drawing Figures

ELECTROPLATING ALUMINUM STOCK

Figure 1:
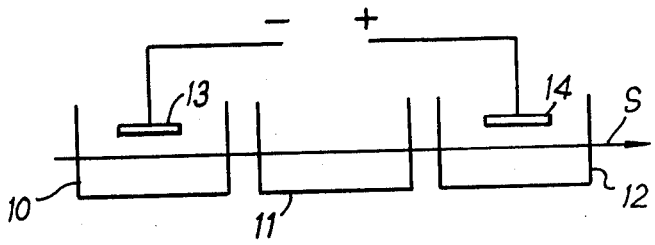

This is a continuation, of application Ser. No. 578,324 filed May 16, 1975 and now abandoned.

This invention relates to electroplating an elongated aluminium stock, such as strip, rod or wire.

One purpose of electroplating aluminium stock is to reduce its electrical contact resistance. Electroplating with tin, for example, avoids the formation of a high resistance, surface film of aluminium oxide.

One known technique for plating aluminium stock with tin involves the successive steps of degreasing, etching, desmutting, immersion tinning, bronze strike, acid conditioning and finally tin plating. The bronze strike and the final tin plating are the only electrolytic steps. Similar treatments are used for plating aluminium stock with other metals.

We have now found that a simplified process of metal plating aluminium is satisfactory, this process involving an electrolytic cleaning treatment of the aluminium stock in acid or alkali under anodic conditions followed by metal plating with, if necessary, intermediate conditioning steps. The electrolytic treatment which is preferably in hot acid can, for instance, replace the non-electrolytic degreasing and etching steps of the tin plating process described above, and can replace similar steps in other metal plating processes.

It is well known to carry out electrolytic cleaning of aluminium under cathodic conditions in continuous anodising treatment of aluminium, but in the present treatment anodic conditions are employed.

In the electrolytic cleaning treatment step, a high concentration of strong mineral acid is preferred, such as 20–50%, for example, 37% $H_3PO_4$, and 10–25%, for example, 18% $H_2SO_4$, or other mixtures of mineral acids having equivalent dissolving power for aluminium oxide, for example 75% $H_3PO_4$ and 5% $HNO_3$, or $H_2SO_4$ (80% by volume) plus $CrO_3$ (25 grams/liter). Other acids, and even alkaline solutions may also be employed provided that they possess sufficient dissolving power for anodic aluminium oxide (similar dissolving power to the above-mentioned phosphoric acid and sulphuric acid solution), as ideally anodic oxide should be removed from the aluminium as rapidly as it forms in the course of this treatment. In general, bath compositions suitable for electropolishing of aluminium will be satisfactory. With the first particular composition given above, a bath temperature of 80°–95° C is satisfactory, and adequate cleaning of aluminium stock occurs with a current density of 100 A/dm$^2$ in about 5 to 6 seconds. Higher bath temperatures may also be used, e.g. up to the boiling point of the solution, as may also lower temperatures, so long as the rate of redissolution of the anodic oxide film does not become undesirably low. A non-electrolytic treatment in the same or a similar bath before and/or after the electrolytic treatment may be of further benefit. These non-electrolytic treatment may be of a duration of 2 seconds each, although a post-treatment of 1 second and no pretreatment can be adequate.

We have found that this method can be conveniently performed during continuous processing, in which the bath liquids themselves are employed as electric contacts. Thus anodes in the metal plating bath and cathodes in the hot acid or alkali electrolytic cleaning treatment stage may be connected to opposite poles of a D.C. supply. This removes the need to use sliding or rolling contacts between the stock and an electrical supply. Such contacts have for long been a source of difficulty in continuous plating operations and can lead to severe maintenance problems due to build up of corrosion products and oxides on the contacts which result in arcing and pitting of both contact and stock.

According to the present invention there is provided a process for the production of metal-plated, elongated aluminium stock which comprises passing the aluminium stock continuously through a bath containing an electrolyte having a high dissolving power for aluminium oxide and subsequently through a bath containing a metal plating electrolyte, the first-mentioned bath having a cathode electrode immersed therein and the second-mentioned bath having an anode electrode immersed therein, whereby to render the stock anodic in the first bath.

The process of the invention so far described is applicable to the plating of aluminium stock with a variety of metals, including tin, and there is particularly provided by the present invention a method of metal plating aluminium stock including the steps of electrolytically cleaning the stock under anodic conditions in hot acid, immersion tinning or zincating the stock, an electrolytic bronze strike (i.e. electrolytic deposition of very thin coating of copper-tin alloy) and electrolytic metal plating. These steps are particularly suitable when thin is the plating metal, but can also be used when, for instance, aluminium is to be plated with brass, zinc, lead, nickel or copper. Preferably the above-described liquid contact principle is used in the cleaning, bronze strike and metal plating steps, in which case the electrodes in the bronze strike and metal plating baths can be connected to the positive terminal of a current source and an electrode in the bath of hot acid to the negative terminal of the source.

Either a non-electrolytic immersion tinning or a zincating step can be used prior to the bronze strike with good results. These steps are needed to prepare the aluminium surface to receive the metal plate from those plating baths with which it is not in itself compatible.

A preferred acid cleaning solution has been given above. If zincating is performed as the second step, an aqueous bath composition as follows may be used:

40 gpl $ZnSO_4.7H_2O$
106 gpl NaOH
40 gpl $KHC_4H_4O_6$ to which may be added 10 gpl KCN.

A residence time of 2 seconds with the bath at 40° C is found to be satisfactory.

If, on the other hand, tinning is selected as the second step, then an aqueous bath composition as follows may be used:

50 gpl $K_2SnO_3.3H_2O$
1.5 gpl $H_3BO_3$

A residence time of 2 seconds is suitable with the bath at 45° C.

For the third step, the bronze strike, a preferred aqueous bath solution is as follows:

140 gpl $K_2SnO_3.\ 3H_2O$
36.5 gpl CuCN
75.5 gpl KCN
7.5 gpl KOH

A temperature of 40° C, a residence time of 2 to 3 seconds and a current density of 20 to 35 A/dm$^2$ provide satisfactory conditions for aluminium stock.

An alternative bath solution for the bronze strike is obtainable from M & T Chemicals Inc. and comprises Alstan 71 (a powder of which 180 gpl may be used) plus Alstan 72 (a concentrate of which 50 ml/l may be used). This may be employed satisfactorily at 40° C with a residence time of 2 seconds and a current density of 30 A/dm$^2$.

The metal plating bath, where the metal is tin, may be as follows:

300 gpl $Sn(BF_4)_2$
200 gpl $HBF_4$
25 gpl $H_3BO_3$
30 gpl gelatin
1 gpl $\beta$-naphthol Alternatively, $H_3BO_3$ and gelatin may be omitted and $HBF_4$ content reduced to 50 gpl. In both cases a temperature of 35° C, residence time of 5 seconds and current density of 100 to 120 A/dm$^2$ are preferably employed where a tin coating of 5 $\mu$m is plated.

The above particularly described conditions are suitable for tin plating aluminium wire of 3.2 mm diameter to a thickness of 5 $\mu$m. A throughput speed of 36 meters/min. is obtainable with these conditions in conjunction with bath lengths of 3.6, 0.9, 0.9 and 3 meters respectively.

It will be seen that this preferred method of the invention allows the omission of the acid conditioning step when compared with the prior known treatment method discussed above. Thus the steps required in conditioning the bare aluminium surface prior to metal plating, particularly tin plating, have been reduced with the advantage that where the liquid contact system is used a minimum length of the aluminium will be required to carry current. This reduces heating and possible wire breaking difficulties.

It has also been discovered that when high current densities of the order of 70–80 A/dm$^2$ are employed in the plating bath the invention can be performed with a much greater efficiency if the stock or electrolytic solution is agitated in the metal plating bath, particularly where tin plating is concerned. This may be conveniently achieved by agitating the stock, for instance by passing the stock through a ring located centrally of the bath and oscillating the ring. The ring may suitably be of polytetrafluoroethylene and located on an arm connected eccentrically to the drive shaft of an electric motor. The improvement achieved by agitation decreases progressively when lower current densities are employed. Agitation may conveniently be carried out by oscillating the ring at 2–20 cycles/sec., more preferably 5–15 cycles/sec. The amplitude of the oscillation may conveniently be in the range 1.5–75 mm, but most usually in the range 5–25 mm. The effect of the oscillation of the stock or agitation of the electrolyte is believed to result in bringing the metal surface into contact with fresh electrolyte, thus continuously replenishing the metal ions in the electrolyte in the intermediate vicinity of the metal surface.

Figure 2:
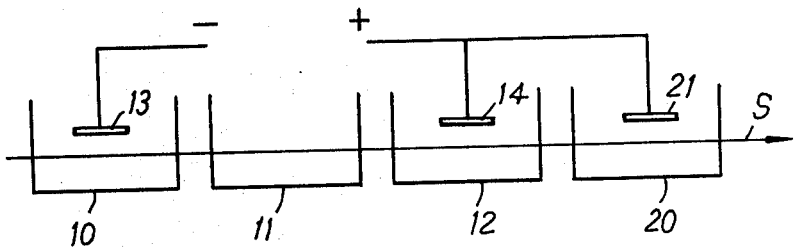
Figure 3:
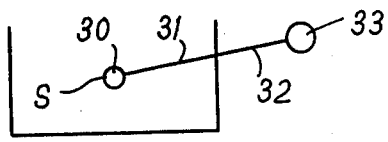

The invention will be more clearly understood from the following description, which is given merely by way of example, with reference to the accompanying drawings, in which:

FIGS. 1 and 2 show schematically apparatus for performing the present invention; and FIG. 3 shows one form of apparatus for oscillating the aluminium stock in the metal plating bath.

FIG. 1 shows the liquid contact principle as may be simply applied according to the present invention. There are three baths, each containing an appropriate solution, and the aluminium stock S moves through them in the direction of the arrow. In the first (leftmost) bath 10 electrolytic cleansing of the stock in hot acid or alkali takes place, in the second bath 11 the stock is treated non-electrolytically with a conditioner while metal plating is carried out in the third bath 12. The conditioning bath 11 may be omitted in plating certain metals from baths which are compatible with bare aluminium, e.g. direct plating. Zinc can be plated on aluminium in this way.

In the first and third baths are respective electrodes 13 and 14, respectively connected to the negative and positive terminals of a current source. In use, current from the source passes from electrode 14, the anode, through the solution to the aluminium stock in bath 12 which is therefore the cathode. The current then passes through the stock to bath 10, leaves the stock and travels to electrode 13 and thence to the source. In bath 10 the stock is anodic and the electrode cathodic. The electrode 13 may be of lead, graphite or stainless steel.

Hot acid which may be such as has been described may be contained in bath 10 and plating solution is in bath 12. The container will be selected according to the plating taking place. Obviously more than one conditioning step can be used, although this may increase the stock length carrying the current.

FIG. 2 shows the application of the liquid contact principle with a further plating step. Like parts are given like reference numerals, when compared with FIG. 1, and it will be seen that the only difference from FIG. 1 is the provision of a second plating bath 20, and a corresponding further electrode 21 connected to the positive terminal of the current source.

An arrangement of this type would be used when performing the preferred method of the invention involving hot acid electrolytic cleaning (in bath 10), zincating or tinning (in bath 11), bronze strike (in bath 12) and metal, particularly tin, plating (in bath 20).

Finally, FIG. 3 shows schematically one method of agitation of the aluminium stock in the metal plating bath. The stock S passes through a ring 30, suitably of polytetrafluoroethylene on one end of an arm 31 pivoted in the bath wall at 32. The other end of the arm is eccentrically mounted on a disc 33 on the shaft of a drive means such as an electric motor (not shown). The ring 30 is suitably halfway along the plating bath, and it has been found that vibrations of amplitude about 10–15 mm at 10 c/s frequency increases greatly the current density which can be used in the plating bath. If the wire is not vibrated in this way, or if the solution in the bath is not agitated, then a longer plating time provided by a longer bath or lower stock speed would be required.

The current which can be used is limited by temperature factors, and the current path in the stock is therefore kept as short as possible.

The vibration of the wire or agitation of the bath is also effective in reducing "treeing" of deposited tin.

Aluminium wire or rod stock can be plated with tin or other metals with the method of the invention. Rod stock can be drawn to smaller diameters, such as normal wire diameters, after tin plating.

In performing the preferred method of the invention with the apparatus of FIG. 2, it will generally be the case that up to 10% of the total current entering the wire will do so in the bronze strike bath, the remainder in the metal plating bath. As the voltages suitable for these operations are similar, in the case of the present example, a single current source can be used although obviously two could be used if desired.

The thickness of the metal deposits can be varied by varying the speed or current.

It will be understood that in the systems of FIGS. 1 and 2 the strip will be washed with water, either by immersion or spraying, in the course of transfer from one treatment bath to the next.

We claim:

1. A process for the production of metal-plated, elongated aluminum stock which comprises passing the aluminum stock continuously (1) during a minor part of a minute through a hot acid electrolytic cleaning bath containing an electrolyte having a high dissolving power for aluminum oxide, said bath consisting essentially of an aqueous, acid solution selected from the group consisting of: 20 to 50% $H_3PO_4$ and 10 to 25% $H_2SO_4$, 75% $H_3PO_4$ and 5% $HNO_3$, and 80% by volume $H_2SO_4$ plus 25 grams per liter $CrO_3$; and subsequently (2) through an electroplating bath containing a metal plating electrolyte, the first-mentioned bath having a cathode electrode immersed therein and the second-mentioned bath having an anode electrode immersed therein, whereby to render the stock anodic in the first bath; the composition and temperature of the solution of the first bath being sufficient for removal of anodic oxide from the aluminum essentially as rapidly as it forms in the first electrolytic treatment, and said first treatment in the hot acid bath being effective to clean the aluminum during its passage therethrough and to deliver the stock with an essentially bare aluminum surface; and electric current, from a supply, for electrolytic cleaning in the first bath and for plating the stock with metal in the second bath being passed from said anode successively through the second bath, the stock and the first bath, to the cathode, without sliding or rolling contacts between the stock and the electrical supply.

2. A process according to claim 1 in which said stock passes through a bronze strike bath intermediate the first bath and said electroplating bath, said bronze strike bath having an anode therein at the same potential as the anode of the plating bath, electric current being passed from the anode of said bronze strike bath through said strike bath to the stock in parallel with the current through the plating bath, and the total current from said plating and strike baths being passed from the stock through the electrolytic cleaning bath to the cathode.

3. A process according to claim 2, which is for production of tin-plated aluminum stock and in which the electroplating bath contains a tin-plating electrolyte.

4. A process according to claim 1, which is for production of tin-plated aluminum stock and in which the electroplating bath contains a tin-plating electrolyte.

5. A process according to claim 1 in which the first mentioned bath is an aqueous solution consisting essentially of 20 to 50% $H_3PO_4$ and 10 to 25% $H_2SO_4$, and is maintained at a temperature in the range of 80° C. and higher.

* * * * *